US007891845B2

(12) United States Patent
Zhang et al.

(10) Patent No.: US 7,891,845 B2
(45) Date of Patent: Feb. 22, 2011

(54) LED LAMP

(75) Inventors: Yi Zhang, Shenzhen (CN); Cheng-Tien Lai, Taipei Hsien (TW); Jin-Song Feng, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 92 days.

(21) Appl. No.: 12/396,475

(22) Filed: Mar. 3, 2009

(65) Prior Publication Data

US 2010/0002438 A1 Jan. 7, 2010

(30) Foreign Application Priority Data

Jul. 4, 2008 (CN) ..... 2008 1 0068334

(51) Int. Cl.
*F21V 29/00* (2006.01)

(52) U.S. Cl. ..... 362/294; 362/218

(58) Field of Classification Search ..... 362/218, 362/249.02, 294, 373, 432, 800
See application file for complete search history.

(56) References Cited

U.S. PATENT DOCUMENTS 7,434,964 B1 * 10/2008 Zheng et al. ..... 362/294
2008/0043479 A1 * 2/2008 Wang ..... 362/373

* cited by examiner

*Primary Examiner*—Y My Quach Lee
(74) *Attorney, Agent, or Firm*—Frank R. Niranjan

(57) ABSTRACT

An LED lamp includes a heat sink having a base and a plurality of LED module assemblies mounted on a top surface of the base of the heat sink. Each of the LED module assemblies includes a fixing bracket secured to the top surface of the base, an LED module mounted on a top surface of the fixing bracket and two heat pipes engaging with the fixing bracket and the heat sink. The fixing bracket includes a bottom plate attached on the top surface of the base, a top plate on which the LED module is attached and a connecting plate interconnecting the bottom plate with the top plate. The heat pipes thermally connect the bottom plate and the heat sink with the top plate.

12 Claims, 5 Drawing Sheets

LED LAMP

BACKGROUND OF THE INVENTION

1. Field of the Invention

The present disclosure relates to LED (light emitting diode) lamps, and more particularly to an LED lamp incorporating heat pipes for improving heat dissipation of the LED lamp.

2. Description of Related Art

Conventionally, an LED lamp comprises a heat sink and a plurality of LEDs mounted on a bottom surface of the heat sink. The LEDs are arranged in a plurality of lines along a length of the heat sink. When the LEDs are activated to lighten, heat generated by the LEDs is dispersed to ambient air by natural air convection via the heat sink.

However, in order to achieve a compact design and facilitate a convenient transportation and handling of the LED lamp, the LED lamp is manufactured to have a small size. The LEDs thus have to be assembled on a small area. Accordingly, heat generated by the LEDs is locally accumulated on the small area, whereby the heat cannot be effectively dissipated to the ambient air, which leads the LEDs to overheat. As a result, the LEDs will operate unstably or even fail.

What is needed, therefore, is an LED lamp having good heat dissipation efficiency.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
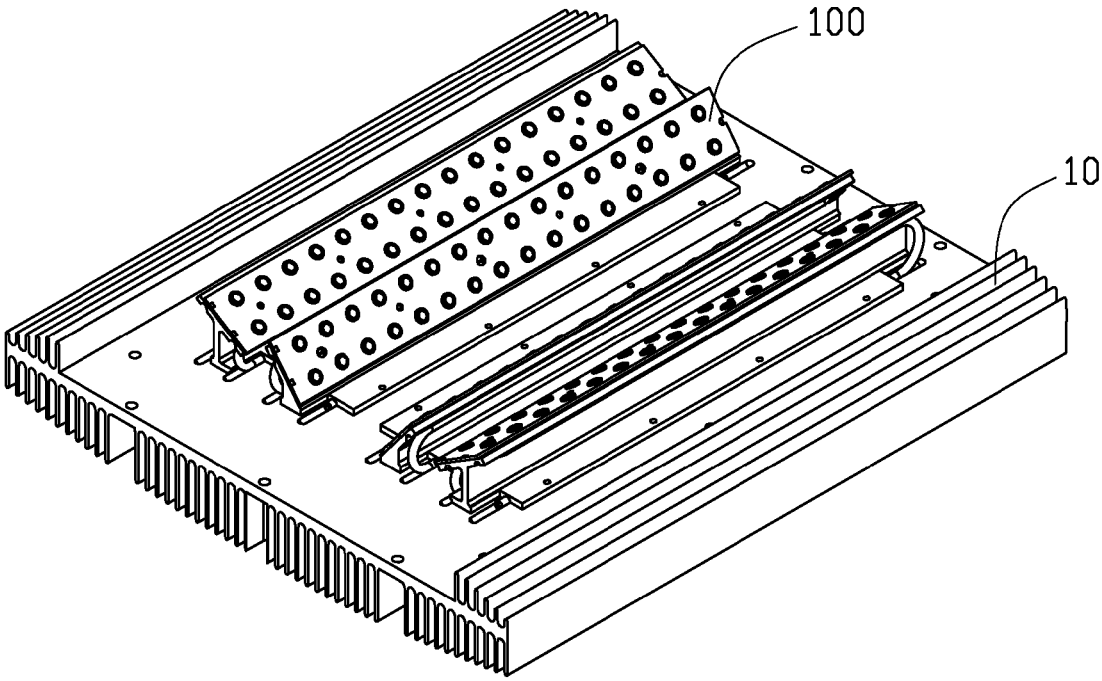
FIG. 1 is an assembled view of an LED lamp in accordance with an exemplary embodiment of the disclosure.
Figure 2:
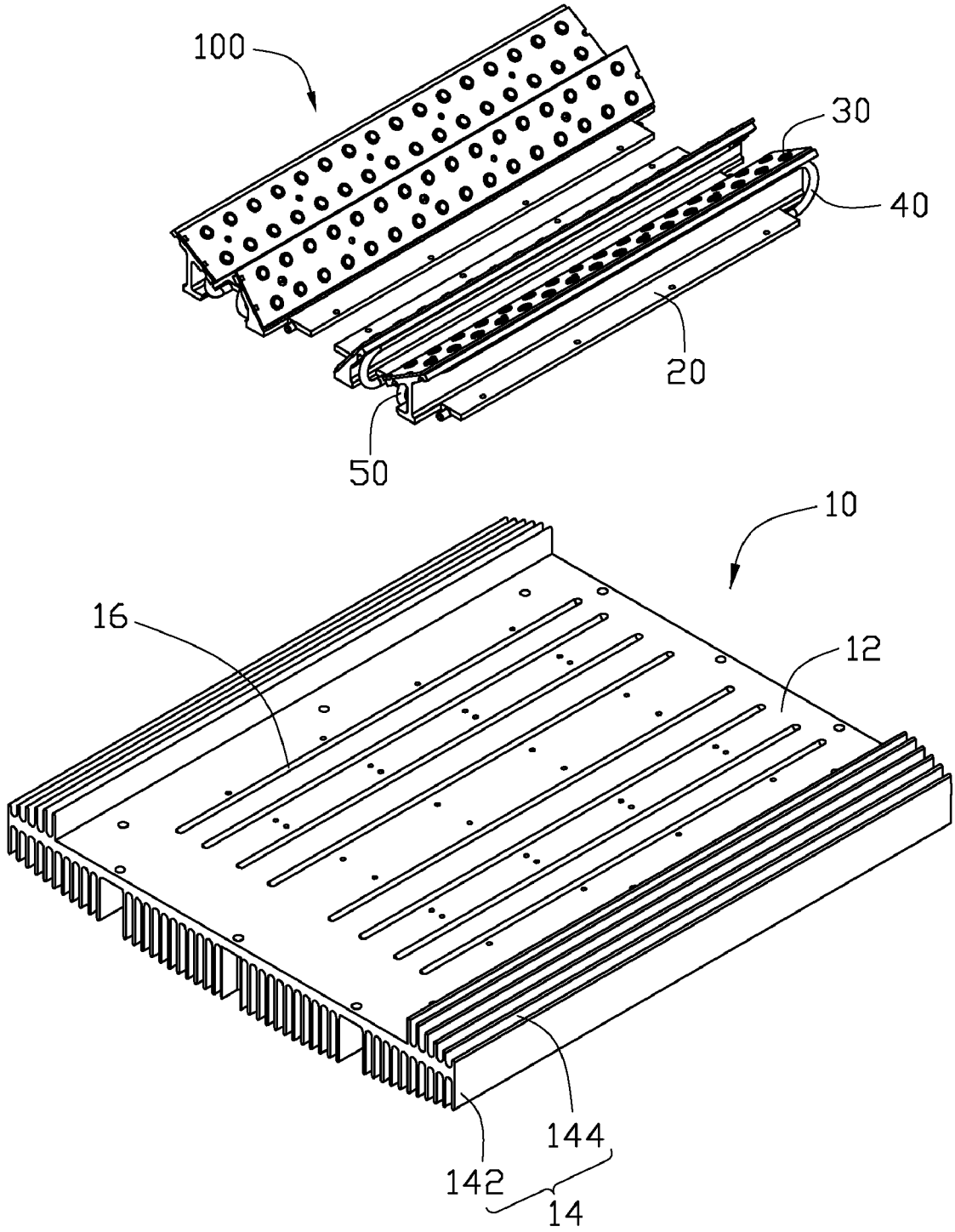
FIG. 2 is an exploded view of the LED lamp of FIG. 1.

Referring to FIGS. 1-2, an LED lamp comprises a heat sink 10 and a plurality of LED module assemblies 100 mounted on a top surface of the heat sink 10 and thermally connecting therewith. Each LED module assembly 100 comprises a fixing bracket 20, an LED module 30 attached to the fixing bracket 20, a first heat pipe 40 and a second heat pipe 50 engaging with the fixing bracket 20.

The heat sink 10 is made of a metal with a high heat conductivity, such as copper or aluminum. The heat sink 10 comprises a substantially rectangular base 12 and a plurality of fins 14 extending from the base 12. The fins 14 are perpendicular to the base 12 and parallel to each other along a width of the base 12. The fins 14 comprise a plurality of first fins 142 extending downwardly from a bottom surface of the base 12 and a plurality of second fins 144 extending upwardly from a top surface of the base 12. The second fins 144 are divided by a wide channel (not labeled) into two parts respectively located at two lateral sides of the base 12. Eight receiving grooves 16 are defined in the top surface of the base 12. The receiving grooves 16 are parallel to each other along the width of the base 12.

Figure 3:
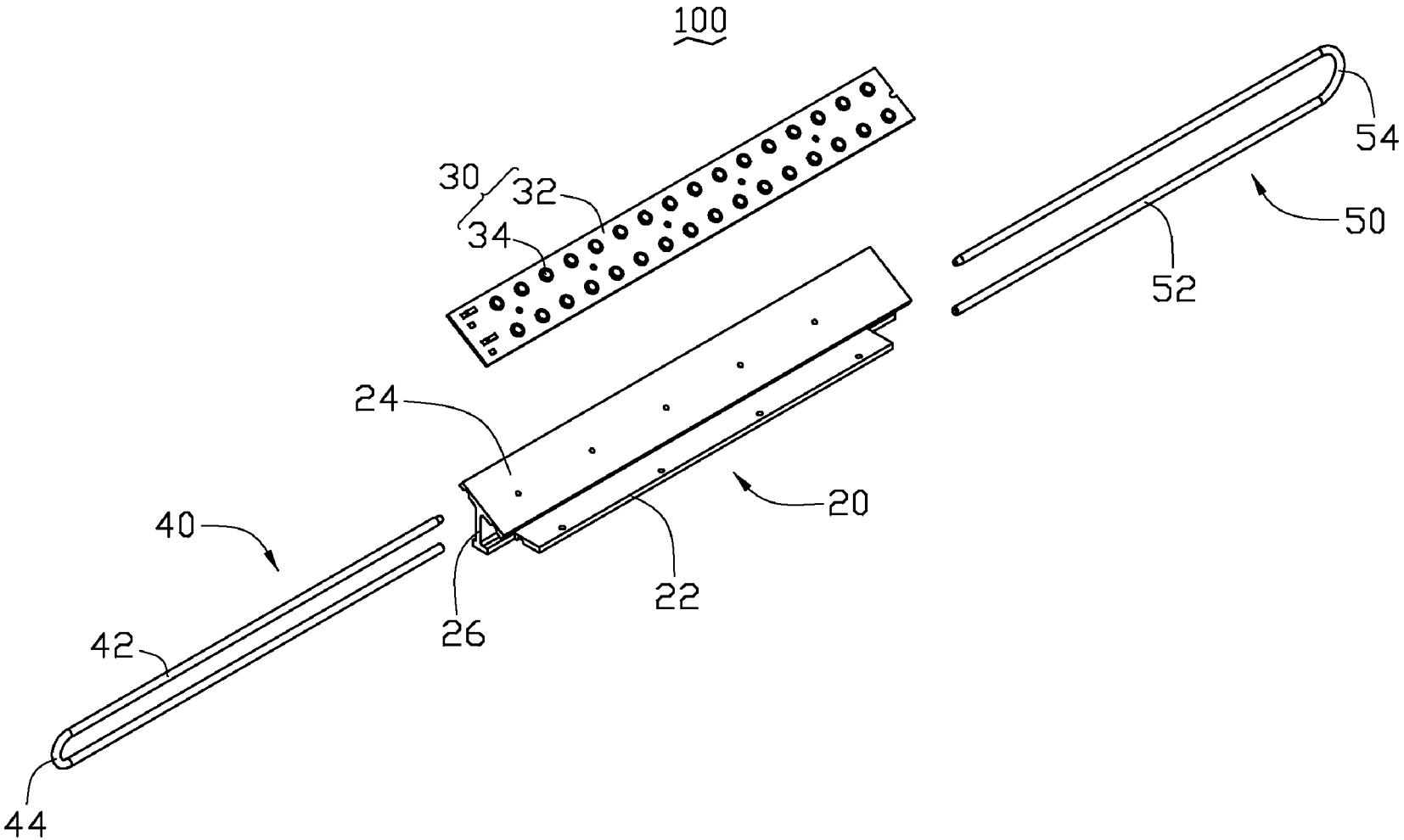
FIG. 3 is an exploded view of an LED module assembly of the LED lamp of FIG. 1.
Figure 4:
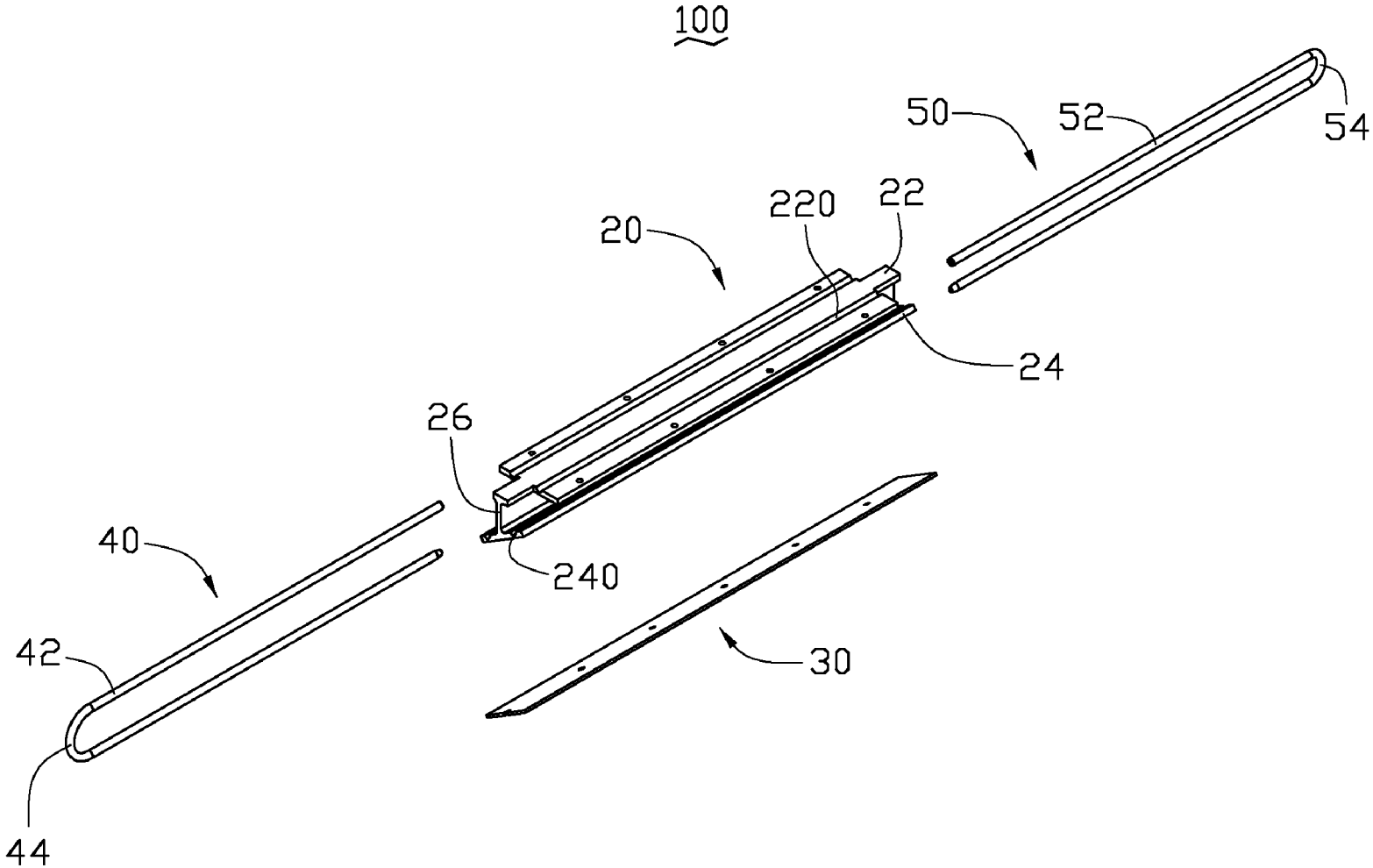
FIG. 4 is an inverted view of the LED module assembly of FIG. 3.

Also referring to FIGS. 3-4, four fixing brackets 20 are mounted on the top surface of the base 12 between the two parts of the second fins 144. The fixing brackets 20 are divided into left and right groups which are symmetrical to a middle line of the top surface of the base 12. Each of the fixing brackets 20 comprises a bottom plate 22 mounted on the top surface of the base 12, a top plate 24 on which the LED module 30 is mounted and a connecting plate 26 interconnecting the bottom plate 22 with the top plate 24. The bottom plate 22, the top plate 24 and the connecting plate 26 are all rectangular metal plates. The connecting plate 26 is perpendicular to the bottom plate 22. The top plate 24 is disposed at an acute angle with respect to the bottom plate 22 and the top surface of the base 12. Two elongated first engaging grooves 220 are defined in a bottom surface of the bottom plate 22 and located respectively adjacent to two opposite lateral sides of the connecting plate 26. Two elongated second engaging grooves 240 are defined in a bottom surface of the top plate 24 and located respectively beside the two opposite lateral sides of the connecting plate 26.

The LED module 30 is thermally mounted on a top surface of the top plate 24 of the fixing bracket 20. The LED module 30 comprises an elongated printed circuit board 32 and a plurality of LEDs 34 mounted on the printed circuit board 32 and arranged along a length of the printed circuit board 32. The LEDs 34 on the printed circuit board 32 are arranged into two lines. The LED modules 30 are so arranged that each LED module 30 is inclinedly oriented toward the middle line of the top surface of the base 12 amid the two lateral sides thereof.

The first heat pipe 40 has a U-shaped configuration and comprises a pair of parallel, spaced first heat-conducting portions 42 and a first connecting portion 44 interconnecting the two first heat-conducting portions 42. One of the first heat-conducting portions 42 is received in one first engaging groove 220 of the bottom plate 22, and another one of the first heat-conducting portions 42 is received in one second engaging groove 240 of the top plate 24. The first heat pipe 40 is located adjacent to a large one of the opposite lateral sides of the connecting plate 26 of the fixing bracket 20. The first connecting portion 44 of the first heat pipe 40 is located adjacent to an end of the fixing bracket 20. The two first heat-conducting portions 42 of the heat pipes 40 have lengths equal to each other.

The second heat pipe 50 is located opposite to the first heat pipe 40 and adjacent to a small one of the opposite lateral sides of the connecting plate 26 of the fixing bracket 20. The second heat pipe 50 has a U-shaped configuration and comprises a pair of parallel, spaced second heat-conducting potions 52 and a second connecting portion 54 interconnecting the two second heat-conducting portions 52. Similar to the two first heat-conducting portions 42 of the first heat pipe 40, one of the second heat-conducting portions 52 is received in another first engaging groove 220 of the bottom plate 22, and another one of the second heat-conducting portions 52 is received in another second engaging groove 240 of the top plate 24. A length of the second connecting portion 54 is less than that of the first connecting portion 44. The second connecting portion 54 is located adjacent another end of the fixing bracket 20 opposite to the first connecting portion 44. A distance between the two heat-conducting portions 52 of each second heat pipe 50 is less than that between the two heat-conducting portions 42 of each first heat pipe 40.

Figure 5:
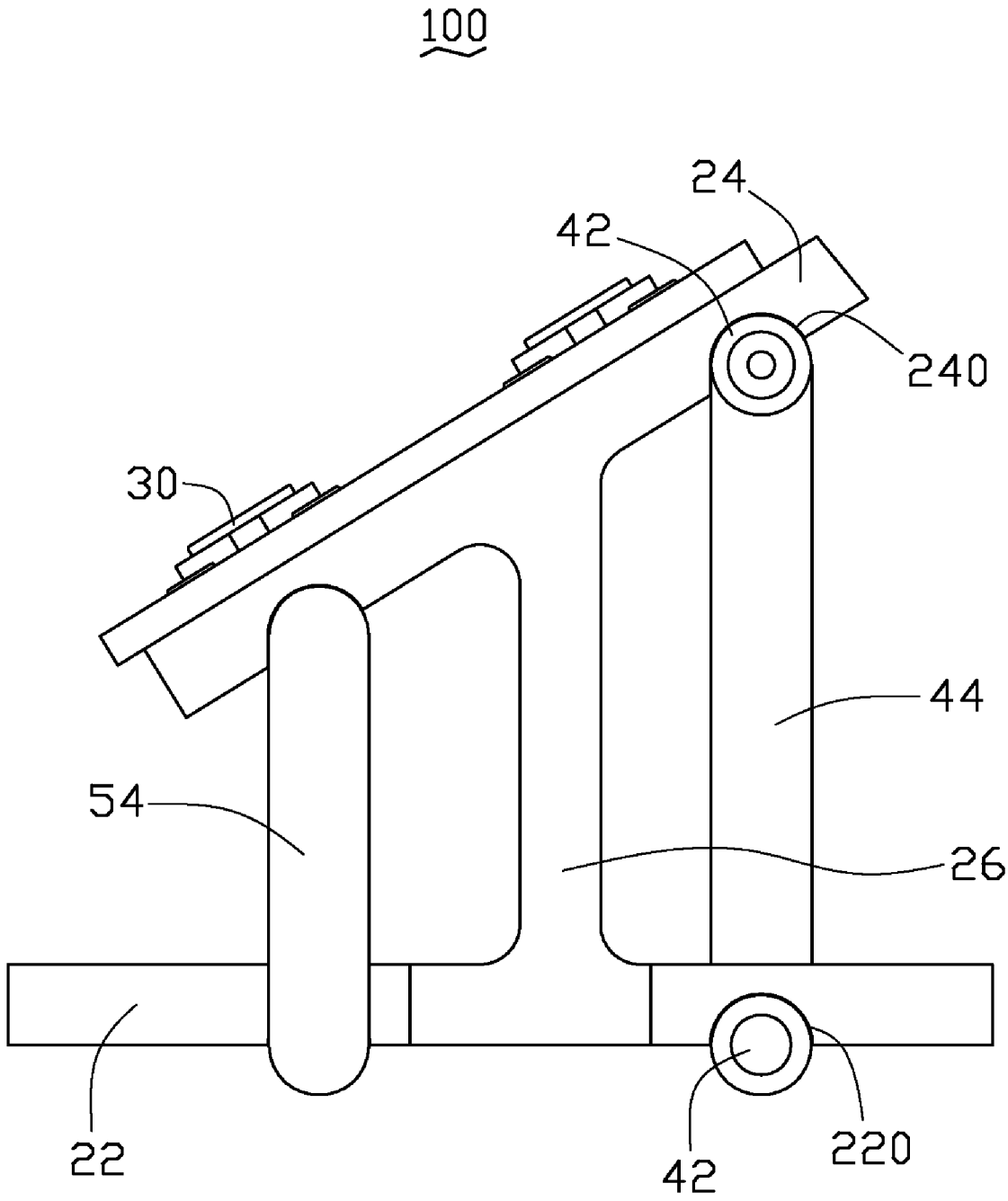
FIG. 5 is a side view of the LED module assembly of the LED lamp of FIG. 1.

Also referring to FIG. 5, in assembly, the four LED module assemblies 100 are mounted on the top surface of the base 12 of the heat sink 10. The two first engaging grooves 220 of each fixing bracket 20 cooperate with two corresponding receiving grooves 16 of the base 12 to form two channels (not labeled). The two channels fittingly accommodate the heat-conducting portions 42, 52 of the first and second heat pipes 40, 50 of a corresponding LED module assembly 100 therein, wherein the heat-conducting portions 42, 52 are partly received in the first engaging grooves 220 in the bottom plate 22 of the fixing bracket 20 beforehand. With the inclined arrangements on the heat sink 10, the LED modules 30 can produce light on a small area in a converged manner, increasing a light intensity of the LED lamp. Furthermore, heat generated by the LED module 30 can be transferred via the fixing bracket 20 and the first and second heat pipes 40, 50 to the base 12 of the heat sink 10, and then dissipated to surrounding air through the fins 14 of the heat sink 10. Thus, the heat generated by the LED lamp can be effectively and timely dissipated, and the LED lamp can work within a normal temperature range.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink comprising a base and a plurality of fins extending from the base; and a plurality of LED module assemblies mounted on a top surface of the base of the heat sink and thermally connecting therewith, wherein each of the LED module assemblies comprises a fixing bracket fixed on the top surface of the base, an LED module mounted on a top surface of the fixing bracket and a heat pipe engaging with the fixing bracket, wherein the fixing bracket comprises a bottom plate attached on the top surface of the base, a top plate on which the LED module is attached and a connecting plate interconnecting the bottom plate with the top plate, and the heat pipe connecting the bottom plate with the top plate;

wherein the heat pipe has a U-shaped configuration and comprises a pair of spaced heat-conducting portions and a connecting portion interconnecting the two heat-conducting portions; and wherein the bottom plate defines a first engaging groove for receiving one of the heat-conducting portions of the heat pipe and the top plate defines a second engaging groove for receiving another one of the heat-conducting portions of the heat pipe.

2. The LED lamp as claimed in claim 1, wherein the top plate is disposed at an acute angle with respect to the bottom plate.

3. The LED lamp as claimed in claim 2, wherein the connecting plate extends perpendicularly from the bottom plate.

4. The LED lamp as claimed in claim 1, wherein each LED module assembly further comprises another heat pipe having a U-shaped configuration and comprising a pair of spaced heat-conducting portions and a connecting portion interconnecting the two heat-conducting portions of the another heat pipe, the connecting portions of the two heat pipes are respectively located adjacent to two opposite ends of the fixing bracket of each LED module assembly.

5. The LED lamp as claimed in claim 4, wherein one of the heat-conducting portions of the another heat pipe is received in another first engaging groove defined in the bottom plate and another one of heat-conducting portions of the another heat pipe is received in another second engaging groove defined in the top plate.

6. The LED lamp as claimed in claim 4, wherein the heat pipe and the another heat pipe are respectively located adjacent to two opposite lateral sides of the connecting plate of the fixing bracket of each LED module assembly.

7. The LED lamp as claimed in claim 4, wherein a plurality of receiving grooves is defined on the top surface of the base for respectively receiving the heat-conducting portions of the heat pipe and the another heat pipe.

8. An LED lamp comprising:

a heat sink having a base and a plurality of fins formed on the base; and a plurality of LED module assemblies mounted on a top surface of the base of the heat sink and thermally connecting therewith, each of the LED module assemblies comprising a fixing bracket fixed on the top surface of the base, an LED module mounted on a top surface of the fixing bracket and a heat pipe connecting the fixing bracket with the base, wherein the LED module assemblies are arranged in a manner that each LED module is inclinedly oriented towards a middle line of the base;

wherein the fixing bracket comprises a bottom plate attached on the top surface of the base, a top plate on which the LED module is attached and a connecting plate interconnecting the bottom plate and the top plate; and wherein the heat pipe has a U-shaped configuration and comprises a pair of spaced heat-conducting portions respectively fixed to the top plate and the bottom plate of the bracket, and a connecting portion interconnecting the two heat-conducting portions.

9. The LED lamp as claimed in claim 8, wherein the top plate is disposed at an acute angle with respect to the bottom plate.

10. The LED lamp as claimed in claim 8 further comprising another heat pipe fixed to the bracket of each LED module assembly, the another heat pipe and the heat pipe being arranged at two opposite sides of the connecting plate of the bracket of each LED module assembly.

11. The LED lamp as claimed in claim 10, wherein the another heat pipe is U-shaped and opened towards a direction opposite to that the heat pipe is opened.

12. The LED lamp as claimed in claim 10, wherein the another heat pipe comprises two heat-conducting portions fixed to the top plate and the bottom plate of the bracket, respectively, and a connecting portion interconnecting the two heat-conducting portions of the another heat pipe, a distance between the two heat-conducting portions of the another heat pipe being less than that between the two heat-conducting portions of the heat pipe.

* * * * *